US007188724B1

(12) United States Patent
Crain et al.

(10) Patent No.: US 7,188,724 B1
(45) Date of Patent: Mar. 13, 2007

(54) CASE FOR VINYL ROLLER TOOL

(75) Inventors: Lance D. Crain, Fremont, CA (US); Tan D. Nguyen, Milpitas, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 358 days.

(21) Appl. No.: 10/845,649

(22) Filed: May 13, 2004

(51) Int. Cl.
*B65D 85/20* (2006.01)

(52) U.S. Cl. ..... 206/349; 206/446; 206/576; 190/18 A

(58) Field of Classification Search ..... 206/15.3, 206/229, 349, 406, 446, 576; 190/18 A
See application file for complete search history.

(56) References Cited

U.S. PATENT DOCUMENTS

| | | | | | |
|---|---|---|---|---|---|
| 2,281,923 | A * | 5/1942 | Davis | 206/576 |
| 4,673,227 | A * | 6/1987 | Anderson | 312/100 |
| 4,743,038 | A | 5/1988 | Myers et al. | 280/40 |
| 4,802,576 | A * | 2/1989 | Kern | 206/225 |
| 4,876,832 | A * | 10/1989 | Wasserman | 52/79.1 |
| 5,520,280 | A * | 5/1996 | Lickton | 206/335 |
| 5,520,400 | A * | 5/1996 | Hung | 280/47.26 |
| 5,645,164 | A * | 7/1997 | Hocking | 206/209 |
| 5,797,410 | A * | 8/1998 | Gates | 134/138 |
| D462,170 | S | 9/2002 | Chen et al. | D3/279 |
| 6,530,470 | B2 * | 3/2003 | Roundy | 206/15.3 |
| 2001/0045715 | A1 * | 11/2001 | Abraham et al. | 280/37 |
| 2004/0188276 | A1 * | 9/2004 | Petrehn | 206/15.3 |

OTHER PUBLICATIONS

Website printout : Gundlach Linoleum Rollers, www. benojgundlachco. com/gc124, 1 page.
Website printout : VCT Tools, www.carpettolls. biz, 1 page.

* cited by examiner

*Primary Examiner*—David T. Fidei
(74) *Attorney, Agent, or Firm*—Schneck & Schneck; Thomas Schneck; David M. Schneck

(57) ABSTRACT

A rolling tool case for holding and transporting a tool. The case includes two sections which are jointed to enclose the tool body in an interior cavity. The handle of the tool extends through an opening hole in the top of the case. The tool's handle may be gripped to roll the tool over a surface, reducing the needed size of the tool case. Wheels on the bottom of one of the two sections allow the case to roll.

20 Claims, 3 Drawing Sheets

CASE FOR VINYL ROLLER TOOL

TECHNICAL FIELD

The present invention relates to a tool case for a vinyl roller in which the handle of the vinyl roller extends through the case towards a user.

BACKGROUND OF THE INVENTION

To install certain types of flooring, such as linoleum, vinyl sheets, rubber tile, vinyl tile, cork tile, wood block tile and other adhesive mounted flooring, a roller device is used for installation of the flooring product. Such a roller provides an even pressure on the flooring, ensuring that the flooring and underlaying adhesive bond. This roller aids in rolling out any bumps, driving air pockets to the edge of a flooring section where the bubble can vent, and distributing any excess adhesive over a broad area. This aids in obtaining the most uniform flooring surface.

One popular vinyl roller tool is sold by Crain Floor Covering Tools (Milpitas, Calif.). This tool is comprised of three cylindrical roller sections connected to a yoke. The yoke is attached to the handle and is pushed by a user, propelling the roller over a surface. The yoke may be detached from the handle.

The rollers commonly are designed such that each of the three roller sections "float" independently on the axle to automatically compensate for subflooring surface irregularity and still allow for pressure to be applied to the flooring material. The sections may be constructed of solid steel and be zinc plated to prevent rust. Solid steel construction provides a tool that will not crack or chip and is highly durable. The roller sections have smooth surfaces and rounded corners to protect flooring materials from indentations. The end roller sections are recessed to inset the axle, eliminating protrusions that could cause wall scuffing. The roller sections are mounted on the yoke using a axle with ends that are tapped to receive threaded bolts. The threaded bolts along with washers are screwed in on the ends to prevent the roller sections from coming loose. A handle is attached to the yoke and extends from the yoke such that it may be gripped by a user.

The tool is quite heavy. For example, rollers are sold weighing 75, 100, or 150 pounds. Transport of such a heavy tool from a vehicle into a building for flooring installation is difficult. The tool should not be rolled over the ground in transporting the tool to the indoor location where the flooring is to be installed. If a tool is rolled over the ground the tool will pick up rocks and dirt onto the roller surface. The heavy weight of the rollers will press the rocks and dirt into flooring sections, causing damage to the flooring. In addition, the surface of the roller will also eventually be damaged if the roller surface is rolled over outdoor surfaces.

One method of transport of a linoleum roller is to simply detach the yoke from the handle and carry the roller. This has a few drawbacks. First, time is required to remove and reattach the handle. Second, there is a risk of injury associated with carrying a roller that can weight up to 150 pounds. Third, given the heavy weight of the tool, there is a risk the tool would be dropped, causing damage to both the tool and the surface onto which the tool was dropped. Finally, to open doors the roller would be set down on an outdoor surface, possibly allowing dirt or rocks to adhere to the roller.

Another alternative is to attach to the yoke a set of transport wheels mounted on a pair of struts. These wheels could be lowered for transport to a down position. In this orientation the transport wheels can contact the ground for rolling the tool. In transport, the rollers do not touch the ground, but are lifted and held even with the bar. When not in use the struts are retracted such that the wheels point to the hand grips.

Again, there are some drawbacks. First, transport of the tool requires an awkward stoop to push the tool handle. Second, the roller still may be dropped or scrape the ground, and will have to touch the ground (for example, if it is required to lift the tool up stairs or open a door.) Third, such transport wheels are commonly made of fabricated steel components, and are quite expensive. Fourth, the bars add considerable weight to the tool. Fifth, folding the struts into the retracted position requires time to loosen securing bolts, reposition the struts, and retighten the bolts. Finally, during rain or snow the rollers in transport would get wet. This would bring water inside, require time to dry the rollers and possibly cause the roller to rust.

It would be desirable to have a device that could allow transport of a flooring roller without risk of damage to the tool or the inconvenience of working with struts.

SUMMARY OF THE INVENTION

The present invention is a rolling case for a vinyl roller. The case includes two case sections that are joined by a hinge, latch or other joining means to define an interior space shaped to hold a tool body, such as a roller, and yoke of a flooring roller tool. One section of the case includes a plurality of wheels allowing the case to be rolled along a surface. The handle of the roller extends through a hole in the case and extends out from the case. The handle may then be grasped by a user and used as the handle for the case. In transport the case and tool are rolled at an angle with respect to a surface.

The case may include a number of additional features, including a handgrip on the case to allow the case to be lifted over stairs, a contoured shaped side of the case to allow the tool to be rolled from the case with a minimal drop off, and case feet on the bottom of the case to allow the case to be stable when set on the ground. The wheels may be mounted on a rod that is embedded into the case and functions as the axle for the wheels. The wheels may be mounted on a corner of the case such that when the case rests on a flat surface the wheels do not contact the ground, but when the case is angled by the handle, the wheels contact the ground allowing the case to roll. When the case rolls, the weight from the case is not on the hinge, preventing the load of the tool within the case from bearing on the hinge.

DETAILED DESCRIPTION OF THE INVENTION

Figure 1:
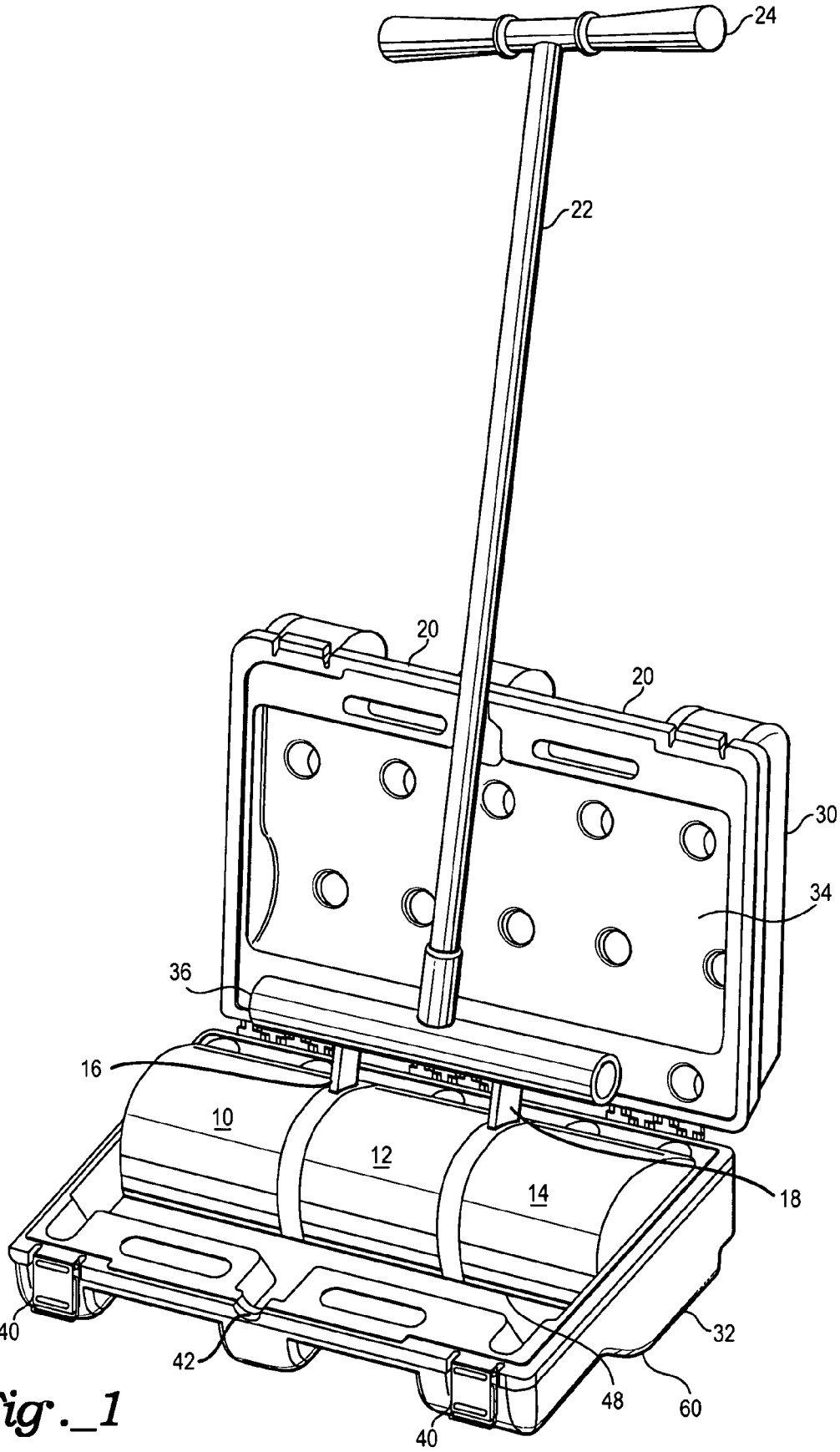
FIG. 1 is a perspective view of the roller in a roller case with the case open.

With reference to FIG. 1, the case is shown open. A linoleum roller is shown within the case. This tool is illustrated as having three sections 10, 12, 14, mounted on an axle attached to bars 16, 18, which are attached to crossbar 36. Bars 16, 18, and 36 make up the yoke of the tool. Attached to the yoke is a handle 22 having a pair of perpendicular hand grips 24. Handgrips 24 are used to propel the roller over a surface when the tool is in use.

The roller is held in a case comprised of two sections, a first section 32 and a second section 30. The internal shape of the sections is designed to hold the vinyl roller and conform to the shape of the roller and yoke. On first section 32, the interior shape of the section 32 forms a yoke holding cavity 48. On section 30 the interior shape of the section and the interior of section 32 form a layer roller holding cavity 34. The roller cavity and the yoke holding cavity allow the roller tool to be placed within the case and retained in the case with minimal movement as the case is transported.

The exterior shape of the case section also provides some desirable and useful features. The shape of first section 32 has an exterior contour that partially conforms to the rounded contour shape of the tool. This rounded dip on one section of the case gives the case a teardrop shape at region 60 on section 32. When the case is opened on the ground, the tool may be rolled or lifted from the case. The exterior contoured shape at region 60 allows the open edge of the case to tip downwards to the surface on which the case has been positioned. The distance the roller must be lifted in order to remove it from the case is thus minimized. It also minimizes the distance which the roller must be lifted in order to put it back in the case.

Figure 2:
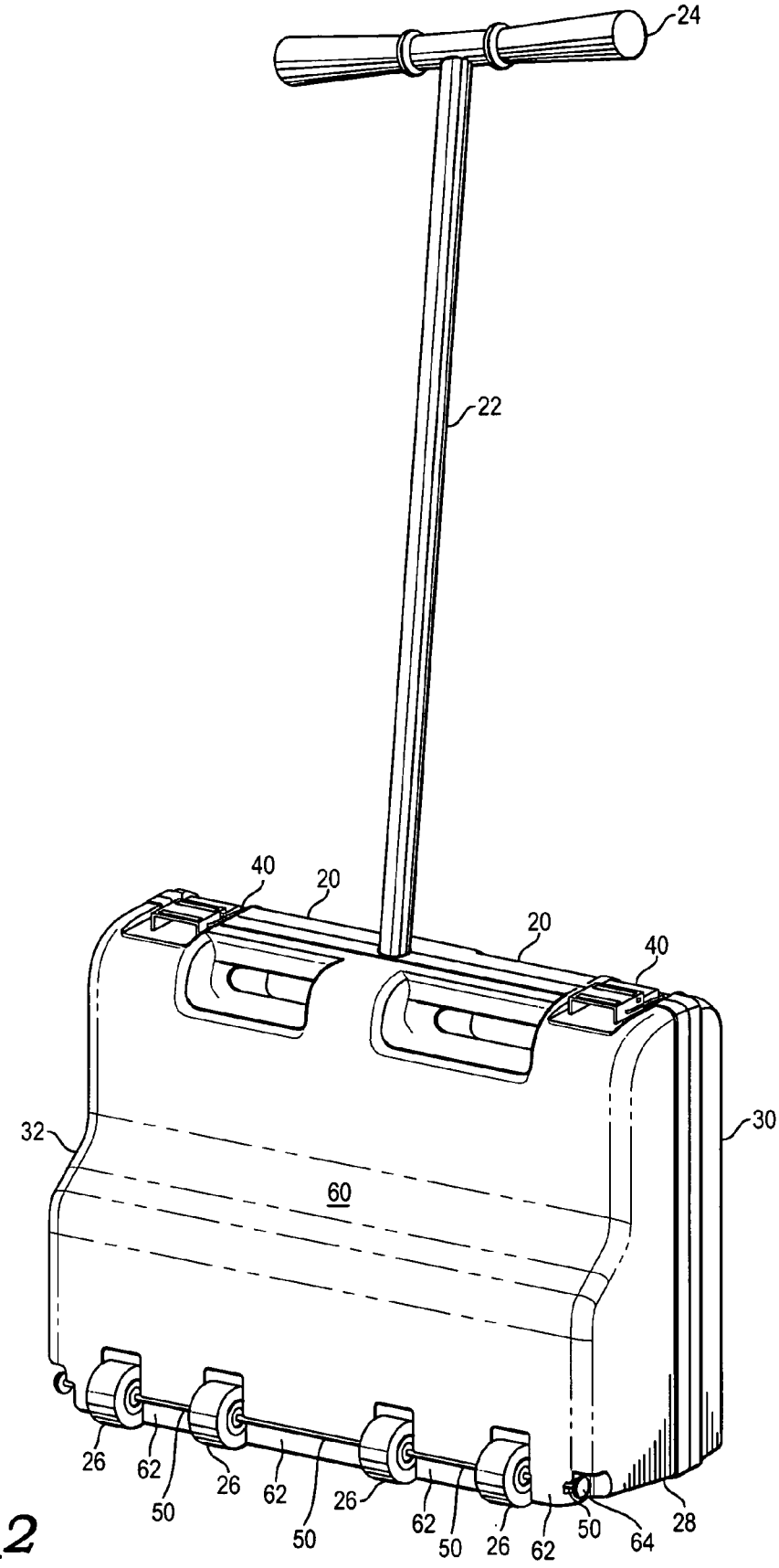
FIG. 2 is a front view of the roller in the roller case with the case closed.

The handle of the tool extends through opening 42 on case sections 32, 30. This is illustrated in FIG. 2, where the tool handle 22 is shown extending from the case. The handle of the tool within the case extends from the case and may be used as a handle for propelling the case over a surface.

In the present document, the term "top" refers to the portion of the case that is closest to the user's hands when the case is positioned upright on its feet on a flat surface (as shown in FIG. 2). The term "bottom" refers to the portion of the case that rests on a surface, again as shown in FIG. 2. On the top of the case is a pair of handles 20 to allow a user to lift the case (or case and tool). This allows lifting the tool from a vehicle, over curbs, up steps, etc. Although the case could be made with one handle, two are preferred. The handles are molded into the case as part of the top of each case section such that when the sections of the case are closed against each other, the handle openings align. Again, this is one selected design, and the handles adapted for the case could include straps or other handles. The top of the case also has a pair of latches 40 to allow the case to be latched shut. The latches could also be on the side of the case. However, latches on the top of the case minimize the risk the latches will snag an object or scratch a surface. Additionally the latches, positioned on the top of the case, do not have a load bearing on the latch.

At the bottom of the case, as shown in FIG. 2, is a hinge 28 joining the first section 32 to the second section 30. This hinge allows the case to fully open (open flat). The case would be usable and hinges could be designed to restrict opening to about 80 degrees between sections or allow opening as great as 200 degrees. However, opening flat to 180 degrees between sections may be most advantageous. Although a hinge is preferred, the two case sections could also be not permanently attached and instead secured by a strap, clip, pin and hole combination, or additional set of latches, or other means commonly known to a person skilled in the art.

Also on the bottom of the case is a set of wheels 26. In the illustrated embodiment of FIG. 2, the wheels are four wheels retained in wheel wells molded into the first section 32 of the case. As illustrated, the wheels 26 may be mounted on a rod 50 which is set into a groove in the case section 32 and extends through mounting brackets 62 on the ends of the case section 32. The ends of the rod 50 are secured with locking nuts or hat rivets 64. This rod acts as the axle for all of the wheels. Alternative wheel designs, such as caster rollers, could also be used.

In the illustrated embodiment, the wheels are mounted on a single axle or the corner of the case. When the case rests on its bottom on a flat surface, the wheels are not in contact with the surface. This is because the case and roller assembly rests on feet 11. When the case is angled for transport, as in FIG. 3, the wheels contact the surface. This feature allows the roller to be stood in a safe position when not in use.

Figure 3:
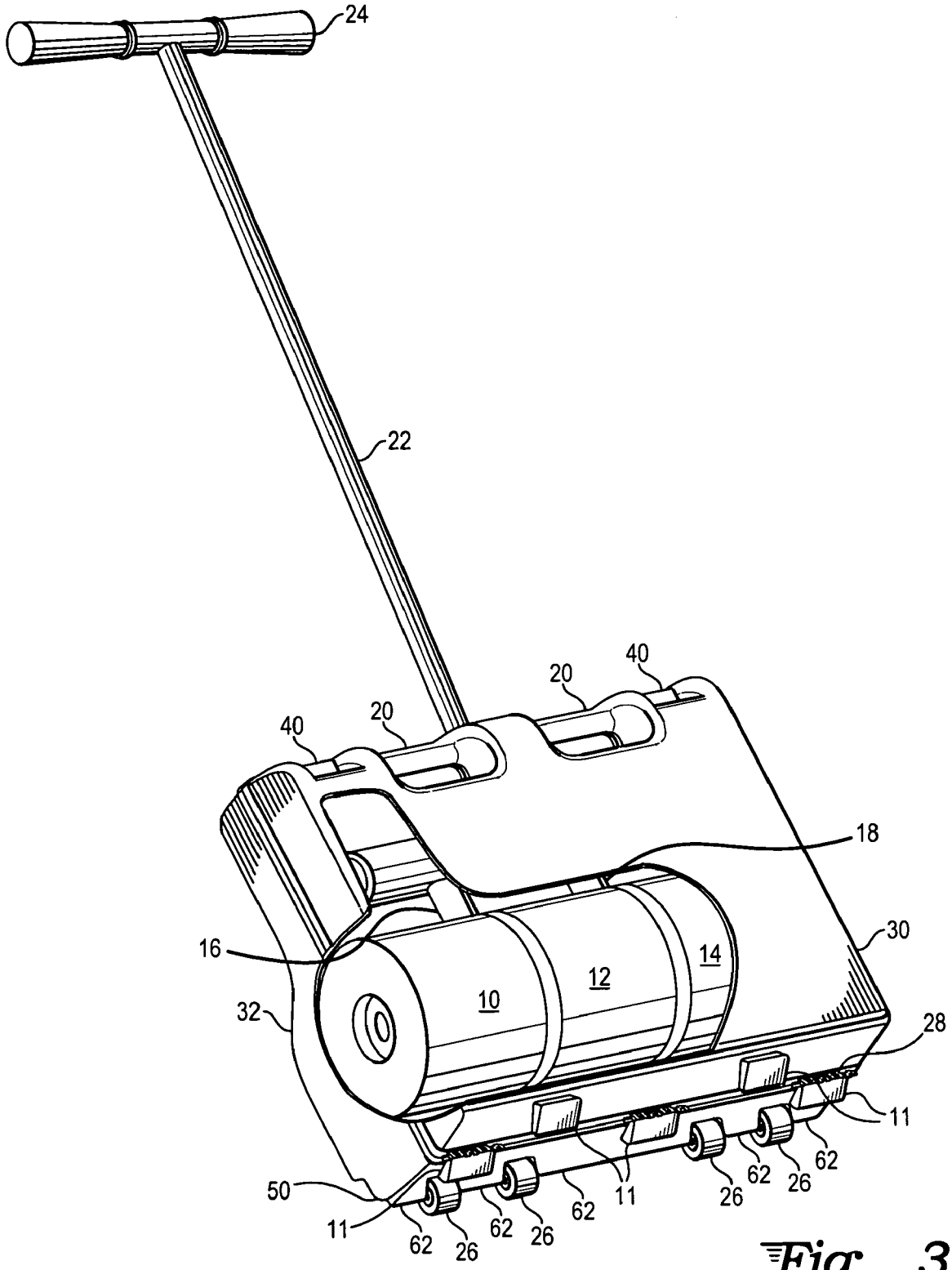
FIG. 3 is a view of the roller case being rolled, with a partial cutaway showing the roller within the case.

FIG. 3 illustrates the tool case as it is used to transport a tool over a surface. The sections 10, 12, 14 of the roller and the bars 16, 18 of the yoke of the roller are all contained within the case.

The case is made of a durable hard plastic material which is light weight yet durable. The total weight added by the case is less than 10 pounds.

The bottom of the case includes feet 11 seen in FIG. 3, on both sections 32, 30 of the case. When the case rests on a surface, as seen in FIG. 2, the case rests on the feet, preventing weight from bearing on hinge 28. The tool's handle 22 extends towards a user in the view of FIG. 3. The user then may propel the tool by pushing handgrips 24. The angle at which the tool and case is held is about the same angle used to push the tool when the tool is in use.

A number of features of the invention may be incorporated into embodiments of the invention. The basic concept of the invention is a rolling case for a tool in which the tool's handle is used as the handle for the case. Some additional features may be desirable.

A first such feature is the location of the hinge. In the illustrated embodiment, the hinge is centrally located on the bottom of the case. The wheels are located on the corners of the case. During transport of the case, as shown in FIG. 3, the weight of the tool is over wheels 26. Hinge 28 is in an offset locator from the main location on the load bearing surface of cavity 34 formed by section 30 and 32, such that weight does not bear on the hinge as the tool is being moved. This could be especially important in retaining case integrity if the case is dropped during transport or is rolled over a curb, step or other drop.

A second such feature is grip handles 20 are built into the top of the case. For transport from a van to the ground, over stairs, or other situations where lifting the tool and case is needed, this pair of grip handles provides an advantageous means for lifting the case with the tool inside.

A third such feature is the location of the latches 40. While the latches could be positioned anywhere the two sections of the case come together, the location of the latches on the top of the case allows for the case to be secured shut while preventing the load within the case from bearing upon the latches as the case is rolled over a surface. The location of the latches also minimizes leverage generated by handle 22.

A fourth feature of the illustrated embodiment is the wheel assembly. In the illustrated embodiment, the four wheels 26 are all mounted on a single metal rod. The rod 50 is press fit into the case into a retaining groove and/or may be mounted on one or more mounting brackets 62 that are part of the case. Each wheel is retained in a wheel well formed by the case. The ends of the rod are fastened with hat rivets 64 to secure the rod 50 and wheel assembly.

A fifth feature of the illustrated embodiment is the curved-outer shape of the case exterior. As seen in FIG. 1, the exterior faces of the two sections of the case have different shapes. One section 32 has a face that is contoured to the shape of the tool, with a curved surface 60 for the section holding the roller and a flattened section for the section holding the yoke. The other section 30 has a uniformly flat face. The curved section allows the tool to be rolled from the case with only minimal lifting required or to be put back into the case with minimal lifting.

The views of FIGS. 1 and 2 also illustrate advantages of the case for use by merchants. As seen in FIG. 1, the case provides a convenient method to display the roller in a shop. In this view one side of the case rests on the floor of a showroom, and the other open end of the case may rest against a wall. The roller section of the tool is held in the case against this case section. This securely holds the roller and prevents the roller from accidentally rolling from a display location and causing damage. In the view of FIG. 2, the tool and case can be used as storage. The tool and case are self standing and stable, the tool is protected from damage, and the combined tool and case require minimal storage area. At a work site, storing the tool upright uses minimal space, ensures that the tool will not roll away, ensures the handle will not fall and damage the wall or floor, and protects the rollers and axle of the tool from scuffing or damage.

The present invention allows the user to roll a tool to a location where it is to be used. Unlike "wheelie bars" presently used to transport linoleum rollers, the present case allows the tool to be transported by gripping a handle at about the same level and angle that would be used to push the tool over a surface. This is a much more natural position for the user. The case also protects the rolling surface of the roller and keeps the rollers and yoke dry.

The invention claimed is:

1. A linoleum roller case comprising:

a first case section having a first bottom and a first top;

a second case section having a second bottom and a second top;

a hinge connecting said first case section to said second case section so that said first and said second sections meet to enclose an interior space defining a roller holding cavity and a yoke holding cavity;

a plurality of wheels mounted on said first bottom of said first case section such that said case can roll over a surface; and a roller handle hole defined by said first case section and said second case section, wherein when a linoleum roller is inserted into the case and the first case section and second case section are brought together a roller and yoke of the linoleum roller are enclosed in the case and a handle of the linoleum roller extends from the case such that a user can roll the case over a surface.

2. The case of claim 1, further including at least one grip handle on a top of the case.

3. The case of claim 1, wherein said first section has a exterior surface that is contoured to a shape of said interior space.

4. The case of claim 1, wherein said plurality of wheels are mounted on a single rod, which forms an axle for the plurality of wheels.

5. The case of claim 1, wherein said plurality of wheels mounted on said case such that when said case is placed with a case bottom surface, said bottom surface opposite a top surface having said roller handle hole on a flat surface said wheels do not contact said surface and when said case is angled for transport on said surface said wheels do contact said surface.

6. The case of claim 1, wherein said plurality of wheels includes four wheels.

7. The case of claim 1, further including a latch on said case.

8. The case of claim 1, wherein said first case section bottom and said second case section bottom include a plurality of feet.

9. The case of claim 1, wherein the hinge is in a position on a case bottom such that the hinge is not a primary load bearing location during rolling transport of said case.

10. The case of claim 1, wherein said hinge allows said first and second section to open between 80 degrees and 200 degrees.

11. A vinyl roller case comprising:

a first case section having a first bottom and a first top;

a second case section having a second bottom and a second top;

a means for connecting said first case section to said second case section so that said first and said second sections meet to enclose an interior space defining a roller holding cavity and a yoke holding cavity;

a plurality of wheels mounted on said first bottom of said first case section such that said case can roll over a surface; and a roller handle hole defined by said first case section and said second case section, wherein when a vinyl roller is inserted into the case and the first case section and second case section are brought together a roller and yoke of the vinyl roller are enclosed in the case and a handle of the vinyl roller extends from the case such that a user can roll the case over a surface.

12. The case of claim 11, further including at least one grip handle on a top of the case.

13. The case of claim 11, wherein said first section has a exterior surface that is contoured to a shape of said interior space.

14. The case of claim 11, wherein said plurality of wheels are mounted on a single rod, which forms an axle for the plurality of wheels.

15. The case of claim 11, wherein said plurality of wheels mounted on said case such that when said case is placed with a case bottom surface, said bottom surface opposite a top surface having said roller handle hole on a flat surface said wheels do not contact said surface and when said case is angled for transport on said surface said wheels do contact said surface.

16. The case of claim 11, wherein said plurality of wheels includes four wheels.

17. The case of claim 11, further including a latch on said case.

18. The case of claim 11, wherein said first case section bottom and said second case section bottom include a plurality of feet.

19. The case of claim 11, wherein the hinge is in a position on a case bottom such that the hinge is not a primary load bearing location during rolling transport of said case.

20. The case of claim 11, wherein said hinge allows said first and second section to open between 80 degrees and 200 degrees.

* * * * *

UNITED STATES PATENT AND TRADEMARK OFFICE

CERTIFICATE OF CORRECTION

PATENT NO. : 7,188,724 B1
APPLICATION NO. : 10/845649
DATED : March 13, 2007
INVENTOR(S) : Lance D. Crain et al.

It is certified that error appears in the above-identified patent and that said Letters Patent is hereby corrected as shown below:

Column 3, line 11 should read -- … section 32 form a larger roller … --.

Signed and Sealed this

Sixteenth Day of December, 2008

JON W. DUDAS
*Director of the United States Patent and Trademark Office*